US009788401B2

(12) United States Patent
Czichy et al.

(10) Patent No.: US 9,788,401 B2
(45) Date of Patent: Oct. 10, 2017

(54) METHOD FOR OPERATING A DISCHARGE LAMP AND PROJECTION ARRANGEMENT

(71) Applicant: OSRAM GmbH, Munich (DE)

(72) Inventors: Marc Czichy, Berlin (DE); Norbert Magg, Berlin (DE)

(73) Assignee: OSRAM GmbH, Munich (DE)

( * ) Notice: Subject to any disclaimer, the term of this patent is extended or adjusted under 35 U.S.C. 154(b) by 287 days.

(21) Appl. No.: 14/532,022

(22) Filed: Nov. 4, 2014

(65) Prior Publication Data

US 2015/0131063 A1 May 14, 2015

(30) Foreign Application Priority Data

Nov. 13, 2013 (DE) ..... 10 2013 223 138

(51) Int. Cl.

| | |
|---|---|
| ***H05B 41/16*** | (2006.01) |
| ***H05B 41/392*** | (2006.01) |
| ***H05B 41/292*** | (2006.01) |
| ***H05B 41/38*** | (2006.01) |

(52) U.S. Cl.

CPC ..... *H05B 41/16* (2013.01); *H05B 41/2928* (2013.01); *H05B 41/38* (2013.01); *H05B 41/3928* (2013.01)

(58) Field of Classification Search

CPC .... H05B 41/16; H05B 41/2928; H05B 41/38; H05B 41/3928

USPC ..... 315/246, 291; 353/85

See application file for complete search history.

(56) References Cited

U.S. PATENT DOCUMENTS

| | | | | |
|---|---|---|---|---|
| 5,608,294 | A | 3/1997 | Derra et al. | |
| 7,023,144 | B2 * | 4/2006 | Suzuki | H01J 61/20 315/246 |
| 7,274,157 | B2 * | 9/2007 | Hirata | H05B 41/2885 315/291 |
| 7,994,734 | B2 | 8/2011 | Breuer et al. | |
| 8,008,868 | B2 * | 8/2011 | Yamauchi | H05B 41/2886 315/209 R |
| 8,525,431 | B2 * | 9/2013 | Yamada | H05B 41/2883 315/287 |
| 8,602,566 | B2 | 12/2013 | Baier et al. | |

(Continued)

FOREIGN PATENT DOCUMENTS

| | | | |
|---|---|---|---|
| DE | 102009006338 | A1 | 9/2010 |
| EP | 0766906 | B1 | 8/2005 |

(Continued)

*Primary Examiner* — Tung X Le

(74) *Attorney, Agent, or Firm* — Viering, Jentschura & Partner mbB

(57) ABSTRACT

Various embodiments provide a projection arrangement. The projection arrangement may include a discharge lamp; and a ballast for the discharge lamp. The ballast is designed to provide, during operation of the projection arrangement, a lamp current in the form of alternating current and having an average frequency and a preset waveform, which has a preset commutation scheme, to the discharge lamp. The preset commutation scheme is preset by a preset time sequence of commutations of the lamp current. The ballast is designed to provide the lamp current in such a way that the preset commutation scheme of the lamp current is deviated from repeatedly with at least one preset intervening time period by at least one DC phase with a preset time duration.

20 Claims, 3 Drawing Sheets

(56) References Cited

U.S. PATENT DOCUMENTS

| | | | | |
|---|---|---|---|---|
| 2004/0000880 | A1* | 1/2004 | Ozasa | H05B 41/2883 315/291 |
| 2010/0084988 | A1* | 4/2010 | Nagata | H05B 41/382 315/246 |
| 2012/0313546 | A1* | 12/2012 | Imamura | H05B 41/2888 315/287 |
| 2015/0077721 | A1 | 3/2015 | Czichy | |

FOREIGN PATENT DOCUMENTS

| | | | |
|---|---|---|---|
| EP | 2852261 | A1 | 3/2015 |
| WO | 2013092750 | A1 | 6/2013 |

* cited by examiner

METHOD FOR OPERATING A DISCHARGE LAMP AND PROJECTION ARRANGEMENT

CROSS-REFERENCE TO RELATED APPLICATION

This application claims priority to German Patent Application Serial No. 10 2013 223 138.5, which was filed Nov. 13, 2013, and is incorporated herein by reference in its entirety.

TECHNICAL FIELD

Various embodiments relate generally to a method for operating a discharge lamp and to a projection arrangement.

BACKGROUND

Projection arrangements known from the prior art, such as, for example, DLP projectors, include a color wheel and a discharge lamp for illuminating the color wheel. The lamps are in this case operated using alternating current and driven by a ballast. In the case of commutation of the lamp current, polarity reversal of the two electrodes of the discharge lamp takes place. When matching the operating frequency of the discharge lamp to the color wheel, the ballast provides a suitable lamp current with a specific wave form in accordance with a commutation scheme.

Gas discharge lamps for video projection applications usually consist of a pair of tungsten electrodes, on which small peaks grow in the case of a suitable mode of operation. These peaks act as root point for the discharge arc and are essential for good performance of the lamp, in particular in respect of a high luminance, low tendency to flicker and low burnback tendency.

For a stable lamp performance, both the geometry and the position of the peaks on the electrode tip need to be kept as constant as possible over the lamp life. The electrode peaks achieve temperatures in the vicinity of the melting point of tungsten during operation at their frontmost end, with the result that tungsten evaporates perpetually. Correspondingly, material needs to be subsequently delivered out of the electrode tip continuously. This can be achieved by virtue of the zone of molten tungsten in the electrode peak being varied cyclically in terms of its extent by temperature modulation. The melting and solidifying processes occurring in the process, in interaction with the high surface tension of tungsten, effect material transport out of the electrode tip forwards into the electrode peak.

Furthermore, the mode of lamp operation needs to be closely matched to the customer application. In particular in DLP projectors, precise synchronization with the color wheel generally used therein needs to take place.

It is known from the prior art that cyclic melting of the peak and an accompanying growth of the peaks can be achieved with the aid of a so-called maintenance pulse at the end of each current half-cycle directly prior to the commutation, as described, for example, in EP 766906 B1. Furthermore, U.S. Pat. No. 7,994,734 B2 and DE 10 2009 006 338 A1 disclose using DC phases repeatedly for avoiding excessive growth of peaks and for reshaping of the peaks. These DC phases are used in this case depending on the lamp voltage. Since the lamp voltage increases proportionally to the spacing between the electrode peaks, it is therefore possible to use the lamp voltage to draw a conclusion on the spacing between the peaks.

U.S. Pat. No. 7,994,734 B2 in this case is concerned with the regression of electrodes since excessive electrode growth results in flicker phenomena and an excessively high lamp current. Since the lamp voltage, as has been mentioned, gives some indication of the spacing between the electrode peaks, the operation of the lamp is regulated depending on the measured lamp voltage as well in accordance with U.S. Pat. No. 7,994,734 B2. If the lamp voltage in this case falls below a limit value, commutations are suppressed in the commutation scheme of the lamp current with which the lamp is operated, with the result that DC phases likewise result here. As a result, fusing-off of the electrode peaks and therefore regression thereof are effected. In this case, DC phases are set with intervening periods which are typically greater than 150 seconds. By virtue of this measure, however, only excessive peak growth can be avoided, but stabilization of the peak position is not possible thereby.

In accordance with DE 10 2009 006 338 A1, a check is performed during operation of the lamp to ascertain whether the lamp voltage is lower than a lower limit value, greater than an upper limit value or between these two limit values. Depending on the range in which the lamp voltage is, DC voltage phases are applied repeatedly with an intervening time period with a duration which depends on the measured lamp voltage. The intervening time period is in this case between 180 s and 900 s in order not to subject the electrodes of the lamp to too much loading. Very long DC voltage phases in this case melt the entire end of the electrode for a short period of time, the electrode ends form to give a spherical shape owing to the surface tension, and therefore the regression of the electrode peaks is effected. Short DC voltage phases only effect fusing-over of the electrode peaks, with the result that the shape of the electrode peaks can be influenced. In order to promote the growth of the peaks, after a long DC phase, a maintenance pulse (already mentioned above) is used. By virtue of the application of these measures, the spacing between the electrode peaks can be influenced and fissuring of the electrode peaks can be avoided, depending on the lamp voltage. However, by virtue of this method, it is likewise not possible to achieve sufficient stabilization of the peak position since in particular even non-fissured electrode peaks can migrate from the center over the course of the life of the lamp, which therefore shortens the life of the lamp.

Therefore, with this procedure only the size of the peak but not the position of the peak can be stabilized sufficiently well. With continuing reduction in size of the effective aperture in modern day projectors, shifting of the peaks is no longer tolerable, however, since a change in the peak position results in a massive reduction in the coupling-in efficiency of the light into the projector optical element and therefore a premature end of life.

One approach for solving this problem consists in modulating the frequency of the lamp current (waveform) with which the lamp is operated in terms of time, as described, for example, in WO 2013092750 A1. In this case, the advantage consists in the well-metered fusing of the electrode peaks, which firstly enables sufficient growth, but secondly also enables stabilization of the peak position. This effect is generally achieved most effectively with waveforms having an average frequency in the region of 90 Hz.

One disadvantage of this solution, however, consists in flicker phenomena, so-called scintillations, which are clearly perceivable on the projection screen. These flicker phenomena can only be combated, as matters currently stand, by virtue of using either waveforms with a symmetrical frequency of 60 Hz or else frequency-modulated, asymmetrical waveforms with much higher frequencies. With both variants, flicker-free lamp operation can be realized, but at the cost of severely reduced life performance.

A further disadvantage of this solution has proven to be the fact that it is often difficult in the case of a specific customer application, owing to the rigidly preset color wheel, to find a suitable waveform with advantageous commutation schemes. In addition, predictions of the response of the lamp and its electrode peaks for a specific commutation scheme can only be made with difficulty or not at all. In order to check whether a specific commutation scheme is suitable, i.e. meets specific criteria in respect of the formation of the electrode peaks and therefore in respect of the life of the lamp, it is necessary to operate a lamp with a lamp current in accordance with this commutation scheme at least for a large proportion of its life or even for its entire life. This is extremely time-consuming and therefore makes the search for suitable commutation schemes and operating modes for a discharge lamp more difficult. A mode of operation of a discharge lamp which reconciles the two requirements for a long life of the discharge lamp and flicker-free operation of the discharge lamp to a satisfactory extent has not been found as yet, however.

SUMMARY

Various embodiments provide a projection arrangement. The projection arrangement may include a discharge lamp; and a ballast for the discharge lamp. The ballast is designed to provide, during operation of the projection arrangement, a lamp current in the form of alternating current and having an average frequency and a preset waveform, which has a preset commutation scheme, to the discharge lamp. The preset commutation scheme is preset by a preset time sequence of commutations of the lamp current. The ballast is designed to provide the lamp current in such a way that the preset commutation scheme of the lamp current is deviated from repeatedly with at least one preset intervening time period by at least one DC phase with a preset time duration.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
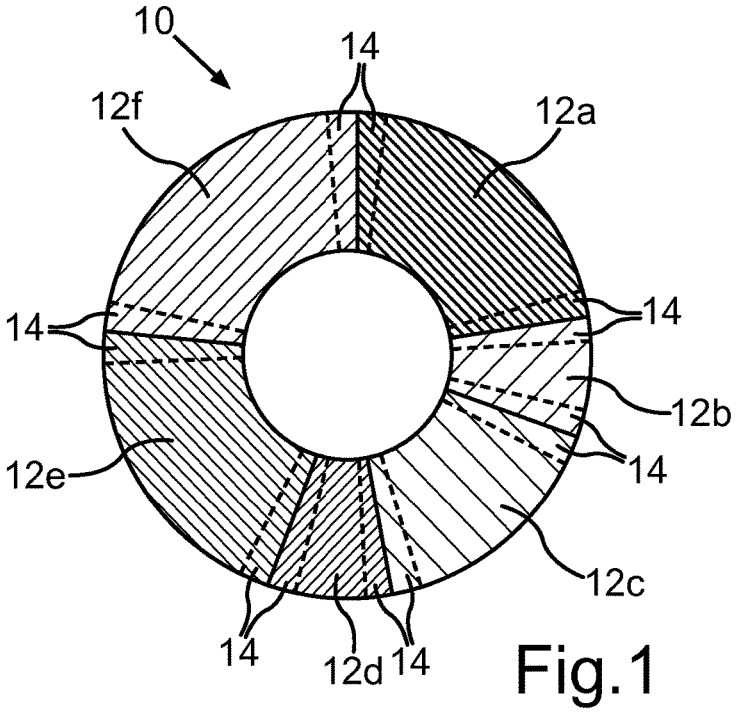
FIG. 1 shows a schematic illustration of a color wheel for a projection arrangement in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may provide a method for operating a discharge lamp and a projection arrangement by means of which improvements in respect of the life of the discharge lamp and flicker-free operation of the discharge lamp can be achieved.

In the method according to various embodiments for operating a discharge lamp including two electrodes for a projection arrangement, during operation, a lamp current in the form of alternating current and having an average frequency and a preset waveform, which has a preset commutation scheme, is supplied to the discharge lamp. In this case, the preset commutation scheme is preset by a preset time sequence of commutations of the lamp current. Furthermore, the preset commutation scheme is deviated from repeatedly with at least one preset intervening time period by at least one DC phase with a preset time duration, wherein the at least one preset intervening time period is at most 50 s.

At least one presettable intervening time period is in this case e.g. to be understood to mean that the intervening time periods between the DC phases do not necessarily need to be the same, so that a plurality of intervening time periods of different length between in each case two DC phases can also be provided, but the intervening time periods are each at most 50 s.

In contrast to the conventional assumptions and procedures, in which DC phases are used for the regression of the electrode peaks and it is assumed that excessively frequent DC phases subject the electrodes to excessive loading and therefore have a negative effect on the life, however, DC phases with suitable timing can also surprisingly be used for the active growth of the electrode peaks and furthermore effect stabilization of the peak position. This effect can be achieved when the intervening time period between the DC phases is selected to be suitably short, to be precise at most 50 s. DC phases with such short intervening time periods not only have a non-life-reducing effect on the discharge lamp, but even considerably extend the life. This is because, owing to the stabilization of the peak position thus effected, migration of the electrode peaks over the course of the life can thus be avoided and the life of the discharge lamp can be markedly extended. A further very significant effect may consist in that, in contrast to solutions in which the peak position can be stabilized in the case of the frequency of 90 Hz which is retrospective for the flicker response of the lamp by means of frequency modulation, one is not restricted to a specific operating frequency of the discharge lamp by virtue of the method according to various embodiments. That is to say that it has been demonstrated that this provision of DC phases with a very short intervening time period extends the life of lamps within a broad spectrum of operating frequencies. As a result, even average frequencies of the lamp current at which the flicker response of this discharge lamp is improved can also be selected in a particularly advantageous manner. By virtue of the method according to various embodiments, it is therefore possible to provide an extension of the life of the discharge lamp and at the same time an improvement of the flicker response.

Furthermore, it has been demonstrated that particularly good stabilization of the peak position can be achieved if the intervening time periods between two DC phases are even shorter. Therefore, a configuration of various embodiments may consist in that the at least one presettable intervening time period is at most 25 seconds, e.g. at most in the single-digit seconds range, and e.g. at most in the milliseconds range. Furthermore, the presettable intervening time period is in this case e.g. at least 5 milliseconds. Precisely in the case of presettable intervening time periods in the single-digit seconds range or less, it has been demonstrated that particularly significant effects can be achieved in this case in respect of an extension of the life of the discharge lamp. In the case of intervening time periods in the milliseconds range, the DC phases can additionally be used to effect asymmetries in the preset commutation scheme, which, as has been demonstrated, likewise has a positive effect on the life of the discharge lamp and, as a result, therefore, the life-extending effect of the DC phases with only a very short intervening time period can be additionally intensified.

In the same way, it may be provided that the at least one DC phase lasts between 5 milliseconds and 100 milliseconds. This is because it has also been demonstrated here that this configuration of the phase durations may have a positive effect with respect to the stabilization of the electrode peaks and therefore with respect to the life of the discharge lamp. The configuration may be provided whereby the phase duration of the DC phases is preset, i.e. the discharge lamp is operated with a lamp current whose commutation scheme is preset, with the commutation scheme being deviated from by the DC phases with a preset intervening time period or intervening time periods and with a preset phase duration or phase durations in a predetermined manner. By virtue of various embodiments, it may be possible to preset a commutation scheme and the above-described configuration of the DC phases and thus to ensure a positive response of the electrode peaks over the entire life and therefore an extension of the life of the discharge lamp.

In an advantageous configuration of various embodiments, at least one parameter of the at least one DC phase is preset by a measured current intensity of the lamp current. The at least one parameter in this case may represent a duration of the at least one DC phase and/or the at least one presettable intervening time period. In this case, a regulation of the parameters of the DC phases may be such that, as the measured current intensity decreases, the DC phases become increasingly frequent, i.e. shorter intervening time periods are preset, and for example, as the measured current intensity decreases, the durations of the DC phases are extended. Therefore, e.g. for a first measured current intensity, which has a magnitude which is less than a second measured current intensity, the at least one parameter is preset in such a way that the duration of the at least one DC phase is longer and/or the at least one presettable intervening time period is shorter than for the second measured current intensity. A decrease in the current intensity or a lower current intensity can in this case be caused, for example, by a progressing life of the discharge lamp and/or also be provided by virtue of the fact that the discharge lamp is being operated in a dimmed mode, in which the operating power of the discharge lamp is reduced in comparison with the nominal power. Since, under certain circumstances, the fusing processes of the electrodes which are responsible for the extension of the life are no longer provided by the DC phases under certain circumstances at a relatively low lamp current intensity, owing to corresponding matching of the parameters of the DC phases depending on the measured lamp current intensity, as described above, optimization of the life may be made possible even in such situations. For this purpose, for example, specific current intensity intervals of the lamp current can be preset, wherein a set of parameters can be assigned to each current intensity interval, relating to, for example, the duration and/or the at least one intervening time period of the DC phases.

At least one DC phase is in this case likewise to be understood to mean that a plurality of different DC phases can also be provided which differ from one another, for example, in terms of their polarity and/or in terms of their duration, wherein e.g. the phase durations of each DC phase are advantageously in the range of between 5 ms and 100 ms.

Furthermore, a DC phase may be a time span in which the polarity of the lamp current is at least effectively not reversed and the two electrodes of the discharge lamp maintain their polarity at least effectively for the duration of the DC phase. In this case, effectively should be understood to mean that the electrodes remain in the respective anode or cathode phase during the DC phase, i.e. do not change from the anode to the cathode phase, or vice versa.

A deviation from the preset commutation scheme by the DC phase should in this case be understood to mean that, in the preset temporal sequence of commutations, at least at a time at which, in accordance with the preset commutation scheme, a commutation of the lamp current would take place and a respective electrode would change from the anode phase to the cathode phase, and vice versa, this change does not take place and the electrodes remain in their respective anode or cathode phase. This can take place by virtue of the fact that one or more successive commutations in accordance with the commutation scheme is/are omitted, for example by virtue of the polarity of the lamp current being maintained instead of a change of polarity of the lamp current. Owing to an implementation which is simpler in terms of circuitry, this "omission" of commutations may be implemented by double commutations, i.e. the lamp current changes polarity twice directly successively at a time. The at least one DC phase is therefore provided by virtue of the fact that at least one commutation in accordance with the preset commutation scheme is implemented as a double commutation. This double commutation is in this case configured in such a way that the two commutations performed in the process succeed one another shortly in time such that the electrodes of the discharge lamp effectively do not change from the cathode phase to the anode phase, and vice versa, but remain in their respective phases. These two commutations of the double commutation in this case take place within a time interval of approximately at most 30 microseconds.

Whether an electrode is in the anode or cathode phase has an influence on the temperature of the electrode. In this case, an electrode is heated in the anode phase and cools down in the cathode phase. By virtue of a DC phase, therefore, a specific temperature profile of a respective electrode is effected. By virtue of the DC phases with an intervening time period in accordance with various embodiments, therefore, a temperature profile of the electrode temperatures can be effected which may have an effect on the stabilization of the peak position. As a result of double commutations during the DC phases, the temperature profile of a respective electrode is in this case barely influenced owing to the very short-term change in polarity, for which reason it effectively makes no difference whether a DC phase is implemented by omission of commutations or by corresponding double commutations.

In a further configuration of various embodiments, the preset commutation scheme is deviated from by a plurality of successive DC phases, which have the at least one preset intervening time period with respect to one another, wherein in each case two temporally successive DC phases have opposite polarities. It may furthermore be provided that the DC phases each have an identical phase duration.

Therefore, the DC phases are equal in terms of their phase duration and alternating in terms of their polarity, with the result that in each case two DC phases which succeed one another with the at least one preset intervening time period have the same phase duration, and wherein e.g. the lamp current in each case two successive DC phases with intervening time periods has different polarity. Owing to the uniform phase duration of the DC phases, the method can be implemented in a particularly simple manner and, precisely also in combination with the alternating configuration of the polarity of the DC phases, it is ensured that both electrodes are subjected to the same loading. This could also be managed, as an alternative to the alternating configuration of the polarity, by virtue of the fact that a first plurality of successive DC phases has a first polarity and the same plurality of successive DC phases has the opposite polarity, e.g. with the precondition of an identical average current intensity during these respective DC phases. In this case, there are many further possible configurations, which relates to the phase duration and the polarity sequence of the DC phases, but the abovementioned configurations are the most simple and effective.

In various embodiments, in this case identical loading of the electrodes should not only be provided by a corresponding design of the DC phases, but generally over the entire operating duration of the discharge lamp.

Therefore, in a configuration of various embodiments, the preset commutation scheme is configured in such a way that the current intensity profile in accordance with this commutation scheme is configured in such a way that there is no DC component remaining on average for a preset time interval. This basic condition in this case ensures uniform loading of the electrodes, e.g. by virtue of the fact that in this case each electrode, when considered over this preset time interval, is in the anode phase and also in the cathode phase for the same amount of time. The preset time interval can in this case represent the entire operating duration of the discharge lamp or else only a periodicity interval in the case of a preset time sequence of commutations and DC phases repeated periodically, for example, since, by virtue of these conditions for a periodicity interval being met, these conditions are also ensured for the entire operating duration of the discharge lamp.

Therefore, in a configuration of various embodiments, the preset commutation scheme is periodic. By way of example, the profile over time of the current intensity in accordance with this periodic commutation scheme can be repeated a plurality of times periodically during the at least one preset intervening time period. This profile does not necessarily need to be repeated integrally. Furthermore, provision can also be made for this temporal periodicity to only relate to the preset commutation scheme, i.e. the deviations from the preset commutation scheme by the DC phases can in this case be configured in such a way that, overall, a non-periodic time profile of the current intensity of the lamp current results. However, provision can also be made for the deviation from the preset commutation scheme by the DC phases in the time sequence, and the formation of the DC phases, e.g. with respect to the phase duration, of the profile over time of the current intensity during this phase duration and the polarity, to be periodic. In various embodiments, it may furthermore be provided that, during a DC phase, the time profile of the current intensity corresponds in terms of magnitude to the time profile of the section of the preset commutation scheme from which there is a deviation by the DC phase at this time. If, for example, one or more segments of a color wheel are intended to be illuminated with an increased light intensity, the corresponding current segments of the commutation scheme of the lamp current have a correspondingly higher current intensity than other current segments. By virtue of the fact that a DC phase now has, in terms of magnitude, the same time profile of the corresponding commutation scheme section, it may be ensured that the intensity profile over time is maintained when illuminating the sequentially illuminated color wheel segments. That is to say that, in the event of a deviation from the preset commutation scheme by a DC phase, therefore, there may be a deviation from the preset commutation scheme with respect to the polarity of the lamp current, but not with respect to the magnitude of the current intensity.

As an alternative to a symmetrical configuration of the DC phases, as described above, i.e. with the same phase duration and alternating polarity, provision can also be made for the DC phases to be distributed asymmetrically among both electrodes, i.e. for a time duration for which an electrode is in an anode phase during the DC phases to be less than or greater than the time duration for which this electrode is in a cathode phase during the DC phases, for example. In other words, the DC phases can be dimensioned in terms of their durations and/or in terms of their intervening time periods in such a way that an electrode is in an anode phase markedly more often or for markedly longer than the other electrode. Owing to the geometry of the design of a projection arrangement, in particular, for example, by virtue of the fact that the electrodes of the discharge lamps do not have the same spacing from a color wheel, different levels of average heating of the respective electrodes over the course of the operating duration of the projection arrangement can arise as a result of back-radiation effects of the color wheel onto the electrodes. By virtue of an asymmetric configuration of the DC phases with respect to the electrodes, this nonuniform heating effect can thus be counteracted.

In a further configuration of various embodiments, the average frequency of the lamp current is at least 180 Hz, and e.g. represents an integral multiple of 60 Hz. As already mentioned, the positive effect of the described configuration of the DC phases on the stabilization of the electrode peaks is not restricted to a specific operating frequency of the discharge lamp. Therefore, an average frequency of the lamp current may be selected by virtue of which the flicker response of the discharge lamp can be improved. As described in more detail in the European application by the same Applicant with the application Ser. No. 13/185,019.0, with so-called 2× actuation of the color wheel, i.e. with actuation of the color wheel such that said color wheel rotates completely twice about the axis of rotation in 16.67 ms, commutation schemes which have an even number of commutations within this time interval of 16.67 ms, i.e. the lamp current has an average frequency of 60 Hz, 120 Hz, 180 Hz, etc., i.e. for example an even multiple of 60 Hz, may be advantageous with respect to the flicker response. Since boundary conditions in respect of uniform loading of the two electrodes still need to be set, again some of these operating frequencies are unsuitable, e.g. multiples of 120 Hz, for which reason average frequencies of 60 Hz, 180 Hz, 300 Hz, etc. have proven to be advantageous. In this case, one effect of average frequencies of greater than or equal to 180 Hz, e.g. those which represent an integral multiple of 60 Hz, may consist in that more degrees of freedom with respect to the arrangement of the commutations of a commutation scheme are provided and e.g. that, in contrast to a frequency of 60 Hz, asymmetric waveforms can be used for the operation of the discharge lamp. By virtue of such frequency-modulated waveforms of the lamp current, likewise the life of the discharge lamp can be extended in comparison with symmetrical waveforms. By virtue of this configuration, the discharge lamp can be operated both without flicker and with a particularly long life. This applies similarly also to so-called 3× actuation of the color wheel, only in that commutation schemes with an uneven number of commutations in the time interval 16.67 ms may be advantageous in respect of the flicker response, for which reason average frequencies of 30 Hz, 90 Hz, 150 Hz, 210 Hz, etc., i.e. uneven multiples of 30 Hz, e.g. result for 3× actuation of the color wheel, wherein further boundary conditions which need to be set in respect of the commutation scheme in addition also e.g. need to be taken into consideration here as well.

A further significant effect of the configurations according to various embodiments furthermore may also consist in that, as a result, not only operation of the discharge lamp at normal power can be optimized, but also for other operating modes of the discharge lamp. Examples are the operation of the discharge lamp in the eco mode with a fixed eco power in the range of 50%-85% of the normal power or operation in the so-called dynamic dimming mode, in which a frame-by-frame modulation of the lamp power takes place depending on the brightness of the screen content. The lamp power can in this case be varied between 30% and 100% of the normal power. The application of the method according to various embodiments and its configurations during operation of the discharge lamp with a reduced operating power in comparison with the normal power may in this case be advantageous since, in general, precisely those dimmed operating modes are particularly susceptible to flicker and this severe flicker in these operating modes has until now needed to be reduced or eliminated whilst only accepting a severely reduced life of the lamp. However, various embodiments now make it possible to ensure flicker-free operation whilst ensuring a long life of the discharge lamp even for such dimmed operating modes of a discharge lamp. Since, as already described, the DC phases are less effective than the normal operation owing to the reduced current intensity of the lamp current in such dimmed operating modes, it may be provided to match the duration and/or frequency of the DC phases to such operating modes, e.g. by virtue of the fact that the durations of the DC phases are extended in comparison with normal operation, and/or the DC phases occur with shorter intervening time periods.

In a further configuration of various embodiments, the intervening time periods between in each case two successive commutations in accordance with the preset commutation scheme are at least sometimes unequal. The average frequency, e.g. also in the case of commutation schemes with intervening time periods of different lengths between in each case two commutations, is in this case defined as half the number of commutations in a specific time interval, in particular in the periodicity interval of the commutation scheme, divided by the length of the time interval, i.e. e.g. by the length of the periodicity interval of the commutation scheme. The temporal sequence of the commutations is in this case preferably matched to a preset color wheel of a projection arrangement. The commutation scheme is in this case synchronized with the color wheel given a set rotational frequency of the color wheel in such a way that commutations of the lamp current only take place when that region of the color wheel which is illuminated by the discharge lamp is located precisely between two color segments, in a so-called blind region. The lengths of the current half-cycles of the commutation scheme, i.e. the intervening periods between two commutations, are in this case provided by the lengths of individual or a plurality of color wheel segments of the color wheel to be illuminated, in particular in the case of high average frequencies at which there is commutation a plurality of times during a color wheel revolution and there is commutation possibly even after each color segment. In this case, with differently sized color segments of a color wheel which is intended to be illuminated by the discharge lamp, current half-cycles of the preset commutation scheme of the lamp current with different lengths also result. The resultant asymmetric, frequency-modulated waveforms may be, as already mentioned, likewise advantageous in respect of the life of the discharge lamp.

The projection arrangement according to various embodiments has a discharge lamp and a ballast for the discharge lamp, which ballast is designed to provide, during operation of the projection arrangement, a lamp current in the form of alternating current and having an average frequency and a preset waveform, which has a preset commutation scheme, to the discharge lamp. The preset commutation scheme is preset by a preset time sequence of commutations of the lamp current. In this case, the ballast is furthermore designed to provide the lamp current in such a way that the preset commutation scheme of the lamp current is deviated from repeatedly with at least one preset intervening time period by at least one DC phase with a preset time duration, wherein the at least one preset intervening time period is at most 50 seconds.

The features mentioned for the method according to various embodiments and its configurations in this case enable the development of the projection arrangement according to various embodiments by virtue of further object features. Furthermore, the features mentioned for the method according to various embodiments and its configurations and the combinations of features and advantages thereof apply in the same way to the projection arrangement according to various embodiments.

Figure 4:
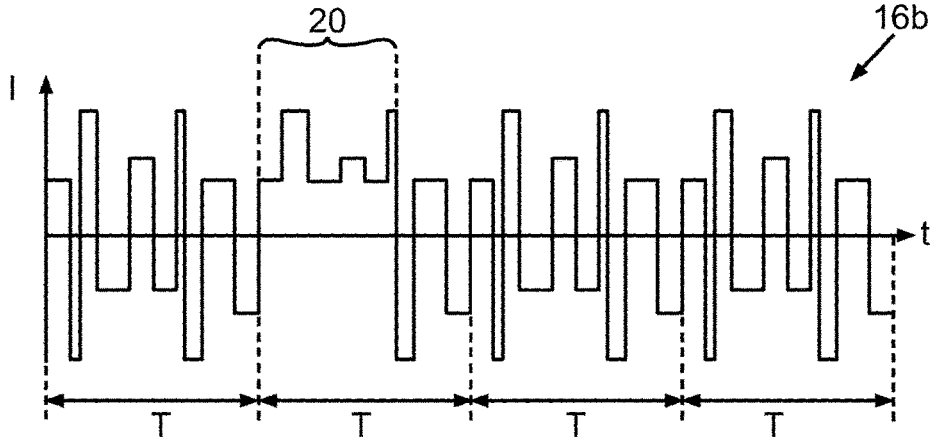
FIG. 4 shows a schematic illustration of a commutation scheme of a lamp current having a DC phase for operating a discharge lamp in accordance with various embodiments, wherein e.g. the changes in current intensity occurring for a short period of time during the implementation of the DC phase by double commutations are not illustrated.
Figure 5:
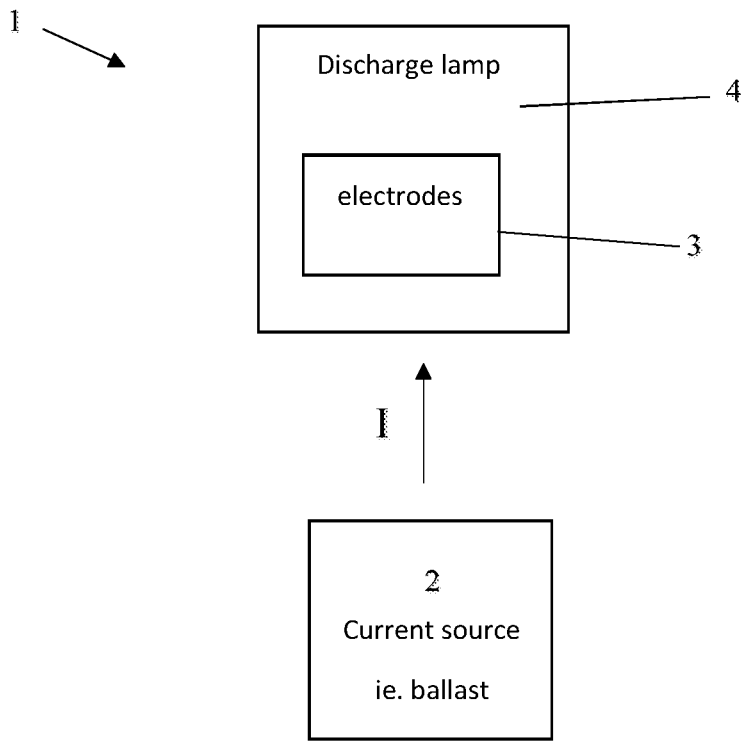
FIG. 5 shows a schematic illustration of a projection arrangement in accordance with various embodiments.

FIG. 1 shows a schematic illustration of a color wheel 10 for a projection arrangement 1 in accordance with various embodiments i.e. FIG. 5. This color wheel 10 in this case has, by way of example, six color segments 12*a*, 12*b*, 12*c*, 12*d*, 12*e* and 12*f*, e.g. a red segment 12*a*, a yellow segment 12*b*, a white segment 12*c*, a cyan-color segment 12*d*, a blue segment 12*e* and a green segment 12*f*. A so-called blind region 14, which is also referred to as a spoke, is located between in each case two color segments 12*a*, 12*b*, 12*c*, 12*d*, 12*e* and 12*f* This color wheel 10 is illuminated by a discharge lamp 4, e.g. a high-pressure gas discharge lamp, which is actuated by an alternating current I in accordance with a preset commutation scheme 16*a*, 16*b* (cf. FIG. 2, FIG. 3 and FIG. 4). The light from the lamp 4 is in this case radiated onto a preset region of the color wheel 10, with the result that, during a rotation of the color wheel 10, the color segments 12*a*, 12*b*, 12*c*, 12*d*, 12*e* and 12*f* are illuminated sequentially. Since a commutation K (cf. FIG. 2) of the lamp current I entails a short-term fluctuation in intensity, commutations K of the lamp current I in this case only take place between two color segments 12*a*, 12*b*, 12*c*, 12*d*, 12*e* and 12*f*, i.e. only when the region onto which the light is radiated is located precisely in a blind region 14 of the color wheel 10. For this purpose, the rotation of the color wheel 10 is synchronized correspondingly with the commutation scheme 16*a*, 16*b* of the lamp current I. The lamp current I in this case does not necessarily need to be commutated in each blind region 14 of the color wheel 10.

Figure 2:
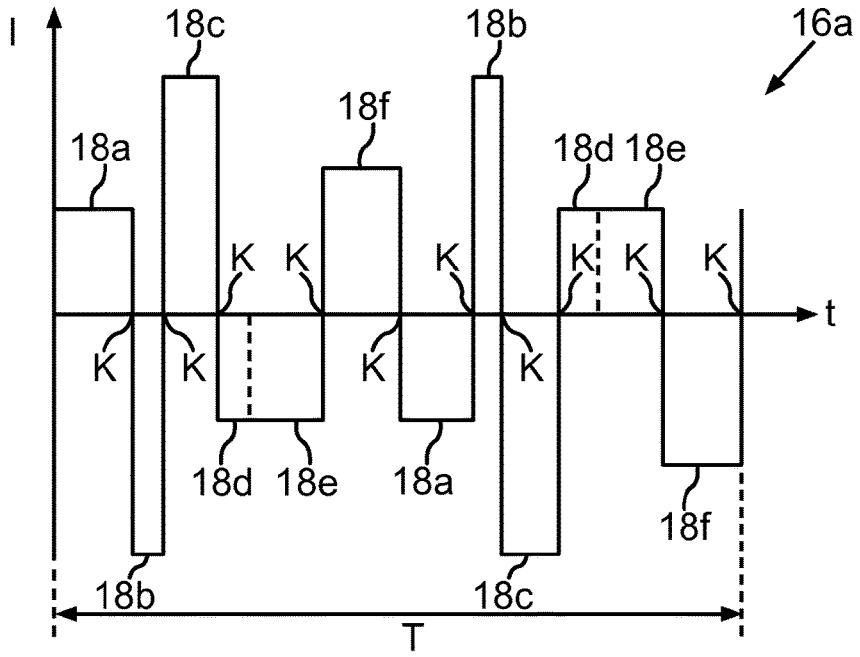
FIG. 2 shows a schematic illustration of a possible commutation scheme for a lamp current with the profile over time which is supplied to the discharge lamp by a ballast, e.g. so as to match the color wheel illustrated in FIG. 1.

In order to illustrate this, FIG. 2 shows a schematic illustration of a possible commutation scheme 16*a* for a lamp current I with a profile over time which is supplied to the discharge lamp 4 by a ballast 2 as shown in FIG. 5, in particular in this case with matching to the color wheel 10 illustrated in FIG. 1. In this case, specifically a periodicity interval of the commutation scheme 16*a* is illustrated with a period duration T, which in this case, by way of example, corresponds to the duration of a double revolution of the color wheel 10. However, a periodic profile over time of the lamp current I which has a lesser or greater period duration T would also be conceivable, with the result that the current profile is only repeated after, for example, a 3-fold, 4-fold, 5-fold, 6-fold, etc. color wheel revolution. Typically, a color wheel 10 in the case of so-called 2× actuation rotates twice in T=16.67 ms, i.e. at a frequency of 120 Hz, and with 3× actuation it correspondingly rotates three times in T=16.67 ms. The commutation scheme 16*a* is preset by a preset temporal sequence of commutations K. The commutation scheme 16*a* therefore has a current segment 18*a*, 18*b*, 18*c*, 18*d* and 18*e*, taken together, and 18*f* between in each case two commutations K, within which current segment the discharge lamp 4 is supplied a direct current with a preset current intensity which is constant over time. The current intensities in the individual current segments 18*a*, 18*b*, 18*c*, 18*d* and 18*e*, taken together, and 18*f* can in this case be different. The magnitudes of these current half-cycles are in this case based on the desire in respect of the weighting of individual color wheel segments 12*a*, 12*b*, 12*c*, 12*d*, 12*e* and 12*f*. In this example, the current segments 18*b* and 18*c* each have a current intensity with a higher magnitude than the other current segments 18*a*, 18*d* and 18*e*, taken together, and 18*f*. As a result, the corresponding color wheel segments, in this case the yellow segment 12*b* and the white segment 12*c*, have a greater weighting.

In this case, in this example the first illustrated current segment 18*a* is synchronized with the red segment 12*a* of the color wheel 10, i.e. the first current segment 18*a* corresponds to the red segment 12*a* of the color wheel 10, the second current segment 18*b* corresponds to the yellow segment 12*b* of the color wheel 10 and the third current segment 18*c* corresponds to the white segment 12*c* of the color wheel 10. The fourth current segment 18*d* and 18*e* corresponds to the light-blue 12*d* and blue segment 12*e* of the color wheel 10, i.e. in this example there is no commutation K of the lamp current I in the blind region 14 between the light-blue segment 12*d* and the blue segment 12*e*. The fifth current segment 18*f* corresponds to the green segment 12*f* of the color wheel 10. After the fifth current segment 18*f*, the scheme is repeated with opposite polarity. This configuration makes it possible to ensure that both electrodes 3 are subjected to equal loading over a relatively long time. In various embodiments, by virtue of this inversion of the current profile of the two halves of the periodicity interval, several necessary conditions for uniform development of the electrode peaks are met directly. Thus, each electrode 3 is in an anode phase and in a cathode phase for the same amount of time, and also the average current intensity in all of the anode phases corresponds to the average current intensity in all of the cathode phases, i.e., when considered over the periodicity interval, the average current intensity is zero. In various embodiments, a respective electrode 3 thus undergoes a specific current profile over time and then renews the same current profile with opposite polarity. Furthermore, with matching to the color wheel 10 illustrated in FIG. 1, the intervening time periods of the commutations K are in this case different. Furthermore, the commutation scheme illustrated has an average frequency of 300 Hz, i.e. 10 commutations K take place in the period duration T=16.67 ms. The maximum average frequency for a 6-segment color wheel in the case of 2× actuation is accordingly 360 Hz when there is only commutation in blind regions 14.

Figure 3:
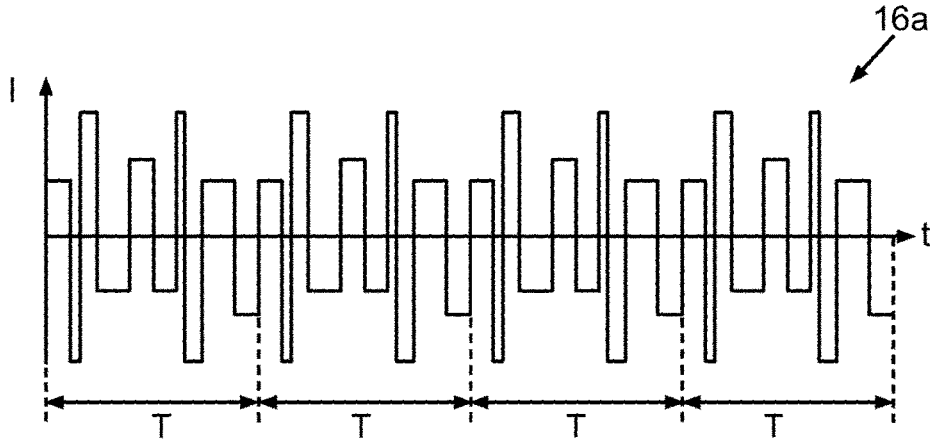
FIG. 3 shows a schematic illustration of the commutation scheme shown in FIG. 2 with a longer time interval.

FIG. 3 shows a schematic illustration of the commutation scheme 16*a* as shown in FIG. 2 with a longer profile over time. In this case, e.g. the repetition of the periodicity interval can be seen.

The waveform of the lamp current, in particular the formation of the commutation scheme, is in this case critical for the lamp performance of the discharge lamp 4, i.e. for its life and for its flicker response. The formation of the commutation scheme in this case has a considerable influence on the formation of the electrode peaks of the discharge lamp 4. The commutation scheme is furthermore subject to basic conditions, such as, for example, the fact that only commutations of the lamp current I in blind regions between two color segments are possible in synchronization with a color wheel, and that the lamp current I is configured such that the two electrodes 3 of the lamp 4 are subjected to equal loading. By virtue of various embodiments, both the susceptibility of the discharge lamp 4 to flicker can be reduced by the actuation of the discharge lamp 4 with a suitable lamp current I, and also the life of the lamp can be extended. For this purpose, with presettable intervening time periods of less than 50 seconds, the preset commutation scheme, as illustrated in this case in FIG. 3, for example, is deviated from by DC phases. In various embodiments, in this case DC phases are generated with regular intervening time periods by implementation of double commutations, which, in the case of a suitable length, i.e. between 5 ms and 50 ms, and repetition rate, i.e. with an intervening time period of e.g. 1 s to 25 s, effect the temperature modulation of the electrode peaks which is necessary for the stabilization of the electrode peaks in respect of geometry and position. For an advantageous effect of this method, both the average lamp frequency and the length of the DC phases and the frequency thereof can be optimized, wherein the selection possibilities in respect of the average lamp frequency are generally significantly restricted by the requirements for the freedom from flicker and by a specific color wheel design. In the case of the parameters for the DC phases, on the other hand, there are no notable limitations, with the result that this method is ideally suitable for use in the widespread 1-chip DLP projectors.

FIG. 4 shows a schematic illustration of a commutation scheme 16*b* of a lamp current I with a profile over time, in particular in accordance with that described with respect to FIG. 2 and FIG. 3, but with a DC phase 20 for operating a discharge lamp 4 in accordance with various embodiments. In this case, the preset commutation scheme 16*a* is now deviated from by this DC phase for a preset time duration. This is achieved by virtue of the fact that, during this DC phase 20, at the times at which, in accordance with the commutation scheme as shown in FIG. 2, a commutation K would take place, a double commutation (not illustrated explicitly) takes place, with the result that, effectively, there is no commutation K of the lamp current I taking place during this time duration. These double commutations are in this case configured as two successive commutations which have a short intervening time period such that, in synchronization with a color wheel, a double commutation only takes place during or within a blind region of the color wheel. In this case, primarily the intervening time period between these DC phases is important for improving the lamp performance. Surprisingly, it has been shown that stabilization of the peak position can be achieved by a relatively short intervening time period between such phases, i.e. in the range between 1 s and 25 s, and even an active growth of the electrode peaks. This effect is surprising to the extent that generally DC phases are used to shorten the length of the electrode peaks and to provide said electrode peaks with intervening time periods which are as long as possible in order to not subject the electrodes 3 to excessive loading.

Furthermore, in various embodiments it may be provided to allow the length of the DC phases to last between 5 ms and 100 ms. Furthermore, the average frequency of the lamp current I should be selected such that, in addition, freedom from flicker can also advantageously be guaranteed. As already described and set forth in more detail in the European application with the application number 13185019.0, this is enabled by the implementation of such commutation schemes in which the change between the anode electrode phase and the cathode electrode phase takes place at a frequency above the perception threshold of the human eye for each color segment of a color wheel.

In the same way, these measures can naturally be implemented for color wheels of different designs and, for example, for 3× actuation. Of primary relevance here are the phase length and the repetition rate of the DC phases in the abovementioned time ranges. In combination with a suitably selected average frequency of the lamp current, as a result enormous advantages in respect of the flicker response and the life of the discharge lamp 4 can be achieved independently of the design and actuation of the color wheel.

FIG. 5 shows a schematic illustration of an embodiment of a projection arrangement 1. The projection arrangement 1 may include a discharge lamp 4. A discharge lamp 4 including two electrodes 3 for a projection arrangement 1. A lamp current I in the form of alternating current and having an average frequency and a preset waveform, which has a preset communication scheme, is supplied to the discharge lamp 4 by a ballast 2. The ballast 2 is designed to provide the lamp current I in such a way that the preset communication scheme of the lamp current I is deviated from repeatedly with at least one preset intervening time period by at least one DC phase with a preset time duration.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A method for operating a discharge lamp comprising two electrodes for a projection arrangement, the method comprising:

a ballast supplying, during operation, a lamp current in the form of alternating current and having an average frequency and a preset waveform, wherein the lamp current has a preset commutation scheme, to the discharge lamp, wherein the preset commutation scheme is preset by a preset time sequence of commutations of the lamp current, and wherein the preset commutation scheme is deviated from repeatedly with at least one preset intervening time period by at least one DC phase with a preset time duration; and pre-setting the at least one preset intervening time period to at most 50 seconds using the at least one DC phase with the preset time duration.

2. The method of claim 1, wherein the at least one presettable intervening time period is at most 25 s.

3. The method of claim 2, wherein the at least one presettable intervening time period is at most in the single-digit seconds range.

4. The method of claim 3, wherein the at least one presettable intervening time period is in the milliseconds range.

5. The method of claim 4, wherein the at least one presettable intervening time period is at least 5 milliseconds.

6. The method of claim 1, wherein the at least one DC phase lasts between 5 milliseconds and 100 milliseconds.

7. The method of claim 1, wherein at least one parameter of the at least one DC phase is preset by a measured current intensity of the lamp current.

8. The method of claim 1, wherein the at least one parameter represents a duration of the at least one DC phase and/or the at least one presettable intervening time period, wherein the at least one parameter is preset in such a way that the duration of the at least one DC phase is longer and/or the at least one presettable intervening time period is shorter than for the second measured current intensity.

9. The method of claim 8, wherein the at least one parameter represents a duration of the at least one DC phase and/or the at least one presettable intervening time period, wherein, for a first measured current intensity, which has a magnitude which is less than a second measured current intensity, the at least one parameter is preset in such a way that the duration of the at least one DC phase (20) is longer and/or the at least one presettable intervening time period is shorter than for the second measured current intensity.

10. The method of claim 1, wherein the at least one DC phase is provided by virtue of the fact that at least one commutation in accordance with the commutation scheme is implemented as double commutation.

11. The method of claim 1, wherein the preset commutation scheme is deviated from by a plurality of successive DC phases, which have the at least one preset intervening time period with respect to one another, wherein in each case two temporally successive DC phases have opposite polarities.

12. The method of claim 1, wherein the preset commutation scheme is deviated from by a plurality of successive DC phases, which have the at least one preset intervening time period with respect to one another, wherein the DC phases each have an identical phase duration.

13. The method of claim 1, wherein the preset commutation scheme is configured in such a way that a current intensity profile of the lamp current in accordance with this commutation scheme is configured in such a way that a preset time interval on average has no DC component.

14. The method of claim 1, wherein the preset commutation scheme is periodic.

15. The method of claim 14, wherein the profile over time of the current intensity in accordance with this periodic commutation scheme is repeated a plurality of times periodically during the at least one preset intervening time period.

16. The method of claim 1, wherein the average frequency of the lamp current is at least 180 Hz.

17. The method of claim 16, wherein the average frequency of the lamp current represents an integral multiple of 60 Hz.

18. The method of claim 1, wherein intervening time periods between in each case two successive commutations in accordance with the preset commutation scheme are at least sometimes unequal.

19. A projection arrangement, comprising:

a discharge lamp; and a ballast for the discharge lamp, which ballast is designed to provide, during operation of the projection arrangement, a lamp current in the form of alternating current and having an average frequency and a preset waveform, wherein the lamp current has a preset commutation scheme, to the discharge lamp, wherein the preset commutation scheme is preset by a preset time sequence of commutations of the lamp current, wherein the ballast is designed to provide the lamp current in such a way that the preset commutation scheme of the lamp current is deviated from repeatedly with at least one preset intervening time period by at least one DC phase with a preset time duration.

20. The projection arrangement of claim 19, wherein the at least one preset intervening time period is at most 50 seconds.

* * * * *